US007093405B2

(12) United States Patent
Andersson et al.

(10) Patent No.: US 7,093,405 B2
(45) Date of Patent: Aug. 22, 2006

(54) UNIT FOR STERILIZING WEB-FED MATERIAL ON A MACHINE FOR PACKAGING POURABLE FOOD PRODUCTS

(75) Inventors: Jan Andersson, Ystad (SE); Karsten Sörensen, Parma (IT); Detlef Elias, Formigine (IT); Filippo Ferrarini, Modena (IT); Ermanno Ricci, Formigine (IT); Fabio Vellani, Modena (IT)

(73) Assignee: Tetra Laval Holdings & Finance S.A., Pully (CH)

( * ) Notice: Subject to any disclaimer, the term of this patent is extended or adjusted under 35 U.S.C. 154(b) by 78 days.

(21) Appl. No.: 10/497,029

(22) PCT Filed: Feb. 7, 2003

(86) PCT No.: PCT/EP03/01238

§ 371 (c)(1),
(2), (4) Date: Nov. 16, 2004

(87) PCT Pub. No.: WO03/066444

PCT Pub. Date: Aug. 14, 2003

(65) Prior Publication Data

US 2005/0076612 A1 Apr. 14, 2005

(30) Foreign Application Priority Data

Feb. 8, 2002 (EP) ..... 02425064

(51) Int. Cl.
*B65B 55/10* (2006.01)

(52) U.S. Cl. ..... 53/167; 53/425; 53/426; 53/551

(58) Field of Classification Search ..... 53/167, 53/550, 551, 425, 426, 450, 451; 422/26–28
See application file for complete search history.

(56) References Cited

U.S. PATENT DOCUMENTS

| | | | | | |
|---|---|---|---|---|---|
| 3,466,841 | A | * | 9/1969 | Anders | 53/426 |
| 3,692,468 | A | * | 9/1972 | Loliger et al. | 53/167 |
| 3,854,874 | A | * | 12/1974 | Loliger et al. | 53/167 |
| 3,911,642 | A | * | 10/1975 | Ernstsson et al. | 53/167 |
| 4,045,939 | A | * | 9/1977 | Baumstingl | 53/426 |
| 4,225,556 | A | * | 9/1980 | Lothman et al. | 53/167 |
| 4,537,007 | A | * | 8/1985 | Lattanzi | 53/425 |
| 5,173,259 | A | * | 12/1992 | Bordini | 53/167 |

(Continued)

*Primary Examiner*—Louis Huynh
(74) *Attorney, Agent, or Firm*—Buchanan Ingersoll PC

(57) ABSTRACT

A unit for sterilizing a web (2) of packaging material on a machine (1) for packaging pourable food products, the unit having a bath (7) containing a sterilizing agent, in which the web (2) is fed continuously; a process chamber (8) connected to an outlet (12) of the bath (7), and which houses wringing rollers (18) interacting with the web (2), and a nozzle (22) for directing a stream of air on to the web (2) and removing residual sterilizing agent from the web; an aseptic chamber (25) communicating with the process chamber (8) via an opening (27) for passage of the web (2), and in which the web (2) is folded and sealed longitudinally to form a tube (29) which is filled continuously with the product for packaging; and an air processing circuit (24) for controlling process conditions, and having a conduit (56) for feeding a first stream of sterile air into the aseptic chamber (25), a conduit (54) for feeding a second stream of sterile air to the nozzle (22) and housing a heater (69) for controlling the temperature of the air supplied to the nozzle (22), and a distributor for regulating the two streams of air.

13 Claims, 4 Drawing Sheets

U.S. PATENT DOCUMENTS 6,354,061 B1 * 3/2002 Bellei et al. ..... 53/167
6,510,669 B1 * 1/2003 Bellei et al. ..... 53/167
6,638,476 B1 * 10/2003 Elias et al. ..... 53/426
6,658,818 B1 * 12/2003 Kurth et al. ..... 53/426
7,007,441 B1 * 3/2006 Benedetti et al. ..... 53/167

* cited by examiner

UNIT FOR STERILIZING WEB-FED MATERIAL ON A MACHINE FOR PACKAGING POURABLE FOOD PRODUCTS

TECHNICAL FIELD

The present invention relates to a unit for sterilizing web-fed material on a machine for packaging pourable food products.

BACKGROUND ART

Machines for packaging pourable food products—such as fruit juice, wine, tomato sauce, pasteurized or long-storage (UHT) milk, etc.—are known, on which packages are formed from a continuous tube of packaging material defined by a longitudinally sealed web.

The packaging material has a multilayer structure comprising a layer of paper material covered on both sides with layers of heat-seal material, e.g. polyethylene. And, in the case of aseptic packages for long-storage products, e.g. UHT milk, the packaging material comprises a layer of barrier material defined, for example, by aluminium foil, and which is superimposed on a layer of heat-seal plastic material, and is in turn covered with another layer of heat-seal plastic material eventually defining the inner face of the package and therefore contacting the food product.

To produce aseptic packages, the web of packaging material is unwound off a reel and fed through a sterilizing unit, in which it is sterilized, for example, by immersion in a bath of liquid sterilizing agent, such as a concentrated hydrogen peroxide and water solution.

More specifically, the sterilizing unit comprises a bath filled, in use, with the sterilizing agent, into which the web is fed continuously. The bath conveniently comprises two vertical parallel branches connected at the bottom to define a U-shaped path long enough to ensure the packaging material is treated for a sufficient length of time. For effective treatment in a relatively short time, and therefore to reduce the size of the sterilizing chamber, the sterilizing agent must be maintained at a high temperature, e.g. around 70° C.

The sterilizing unit also comprises a process chamber located over the bath, and in which the web of packaging material is dried; and an aseptic chamber, in which the web is folded and sealed longitudinally to form a tube, which is then filled continuously with the product for packaging.

More specifically, in the process chamber, the web is processed to remove any residual sterilizing agent, the acceptable amount of which in the packaged product is governed by strict standards (the maximum permissible amount being in the region of a few fractions of a part per million).

Such processing normally comprises mechanical removal of any drops on the material, followed by air drying.

The drops may be removed, for example, by feeding the material through a pair of wringing rollers conveniently located close to the process chamber inlet, and downstream from which the material is still covered with a film of sterilizing agent, but has no macroscopic drops.

Drying may be performed by directing jets of sterile air on to the material.

Before leaving the aseptic chamber, the web is folded into a cylinder and sealed longitudinally to form, in known manner, a continuous, longitudinally sealed, vertical tube. In other words, the tube of packaging material forms an extension of the aseptic chamber, and is filled continuously with the pourable food product and then fed to a forming and (transverse) sealing unit for forming the individual packages, and on which the tube is gripped and sealed transversely between pairs of jaws to form aseptic pillow packs.

The pillow packs are separated by cutting the seals between the packs, and are then fed to a final folding station where they are folded mechanically into the finished shape.

Packaging machines of the above type are used widely and satisfactorily in a wide range of food industries for producing aseptic packages from web-fed packaging material. Performance of the sterilizing unit, in particular, ensures ample conformance with standards governing sterility of the packages and the amount of residual sterilizing agent.

A need for further improvement, however, is felt within the industry itself, particularly as regards temperature control of the air used to dry the packaging material web in the sterilizing unit.

Tests have shown, in fact, that, besides drying the web, localized hot-air treatment at the outlet of the sterilizing agent bath synergically improves the effectiveness of the sterilizing agent.

In known machines, the pressure and temperature conditions in the process and aseptic chambers are normally controlled by a closed air processing circuit, which draws air from the process chamber and feeds it back into the aseptic chamber, the temperature of which is controlled by a sensor. The airstream directed on to the packaging material may be generated by "air knives" supplied with air from the sterile chamber, e.g. by means of a recirculating conduit, as described in EP-A-1 050 467.

Since, in this solution, the temperature of the air supplied by the air knives cannot be regulated independently, a process parameter balance designed to simultaneously optimize drying and sterilizing efficiency ("killing rate") is extremely difficult to achieve.

In an alternative known solution, drying is performed in a low drying channel, through which the material is fed from the process chamber into the aseptic chamber. In this case, too, however, there is no independent adjustment of the air temperature inside the drying channel.

Another problem connected with poor temperature control of the air fed into the aseptic chamber is the risk, in certain operating conditions, of overheating the packaging material, thus resulting in "blistering" between the layers.

DISCLOSURE OF INVENTION

It is an object of the present invention to provide a unit for sterilizing packaging material, designed to eliminate the aforementioned drawbacks typically associated with known units.

According to the present invention, there is provided a sterilizing unit for sterilizing a web of packaging material on a machine for packaging pourable food products, the sterilizing unit comprising:

a bath containing a sterilizing agent, in which said web is fed continuously;

an aseptic environment comprising a process chamber connected to an outlet of said bath and housing drying means for removing residual sterilizing agent from said web; and an aseptic chamber communicating with said process chamber via an opening for the passage of said web, and in which said web is folded and sealed longitudinally to form a tube which is filled continuously with the product for packaging;

said drying means comprising at least one nozzle for directing a stream of sterile air on to said web; and an air processing circuit for controlling the process conditions in said aseptic environment, and comprising suction means for drawing air from said process chamber; and air processing means comprising first heating means, and first supply means for feeding sterile air into said aseptic chamber;

characterized by comprising second supply means for supplying sterile air from said air processing means to said nozzle; and second heating means associated with said second supply means and for controlling the temperature of the air supplied to said nozzle.

The temperature of the air fed into the aseptic chamber and the air emitted by the nozzle to dry the web can therefore be controlled effectively and independently in any operating condition to achieve optimum drying and sterilization with no risk of damaging the packaging material by exposing it to excessively hot air.

In a preferred embodiment of the invention, valve means are provided to connect the first supply means and second supply means adjustably to the air processing means, so that the sterile air fed into the aseptic environment can be distributed differently between the aseptic chamber and the nozzle, depending on the operating stage of the machine, to operate in optimum pressure conditions at all times.

BRIEF DESCRIPTION OF THE DRAWINGS

A preferred, non-limiting embodiment of the present invention will be described by way of example with reference to the accompanying drawings, in which.

BEST MODE FOR CARRYING OUT THE INVENTION

Figure 1:
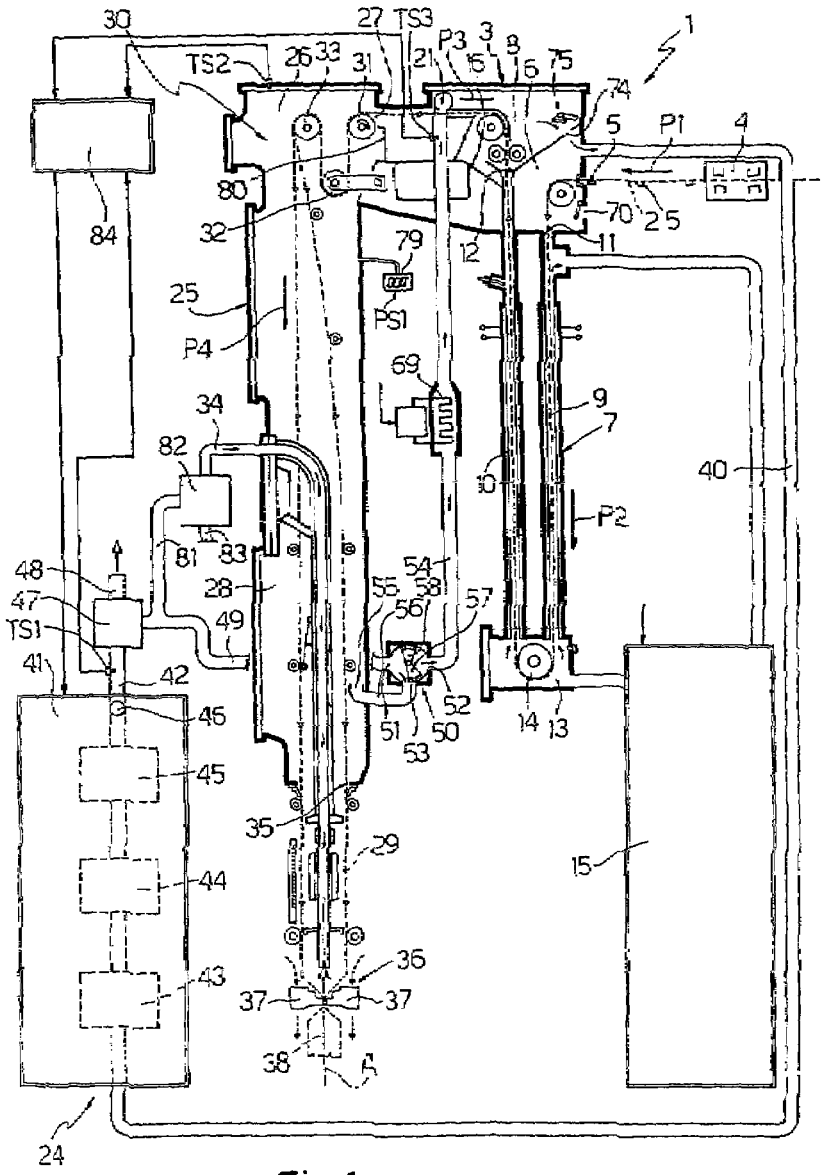
FIG. 1 shows a diagram of a machine for packaging pourable food products and featuring a sterilizing unit in accordance with the invention.

Number 1 in FIG. 1 indicates as a whole a machine for packaging pourable food products, and for continuously producing aseptic packages of a pourable food product from a web-fed packaging material 2 (hereinafter referred to simply as "web 2").

Machine 1 comprises a sterilizing unit 3 for sterilizing web 2, and to which web 2 is fed off a reel (not shown) along a path P1.

Machine 1 also comprises a unit 4, located upstream from sterilizing unit 3, for applying closable opening devices 5 to web 2, and which is conveniently defined by a known station for injection molding plastic material, and through which web 2 is fed in steps. On leaving unit 4, the web comprises a succession of equally spaced opening devices 5 (shown schematically in FIG. 1 on only a portion of web 2) projecting from one face of web 2—in the example shown, the bottom face.

Sterilizing unit 3 comprises a transition chamber 6, into which web 2 is first fed; a sterilizing bath 7 containing a liquid sterilizing agent, e.g. a solution of 30% hydrogen peroxide ($H_2O_2$) and water, through which web 2 is fed; and a process chamber 8, in which web 2 is dried as explained in detail later on.

Bath 7 is substantially defined by a U-shaped conduit, which is filled, in use, with sterilizing agent to a predetermined level, and which in turn is defined by two vertical, respectively inlet and outlet, branches 9, 10 having respective top openings 11, 12, which respectively define the web 2 inlet and outlet of bath 7, and communicate respectively with transition chamber 6 and process chamber 8. The two branches are connected at the bottom by a bottom portion 13 of bath 7, in which is housed a horizontal transmission roller 14.

Inside bath 7, web 2 therefore travels along a U-shaped path P2, the length of which is defined to ensure the packaging material is kept long enough in the sterilizing agent.

Bath 7 is connected to a known peroxide control circuit 15 (not described in detail), and is maintained, in use, at a controlled temperature, e.g. of about 70° C.

Figure 3:
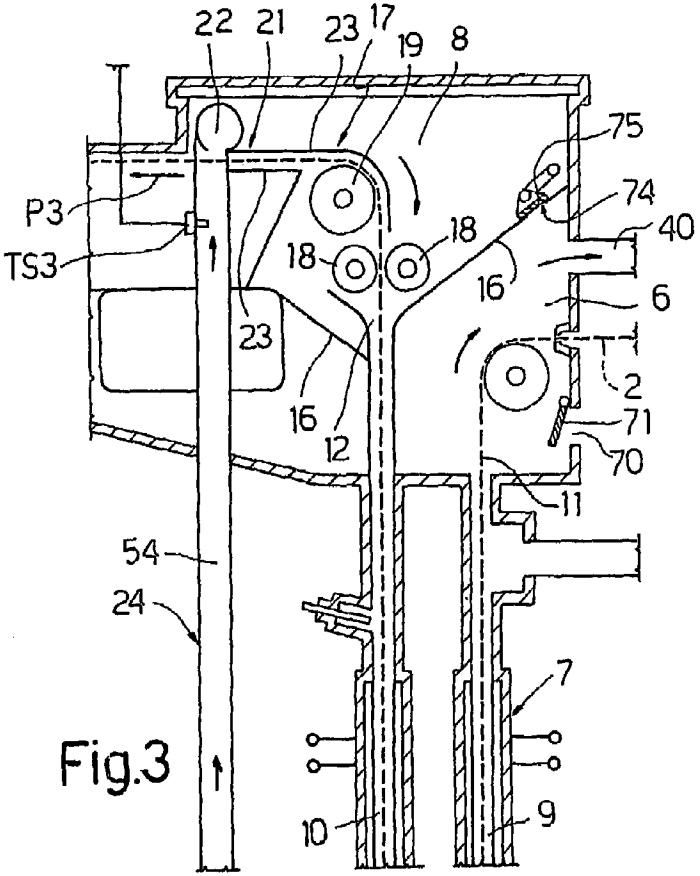
FIGS. 2 and 3 show schematic partial sections of the sterilizing unit according to the invention in two different operating conditions.
Figure 2:
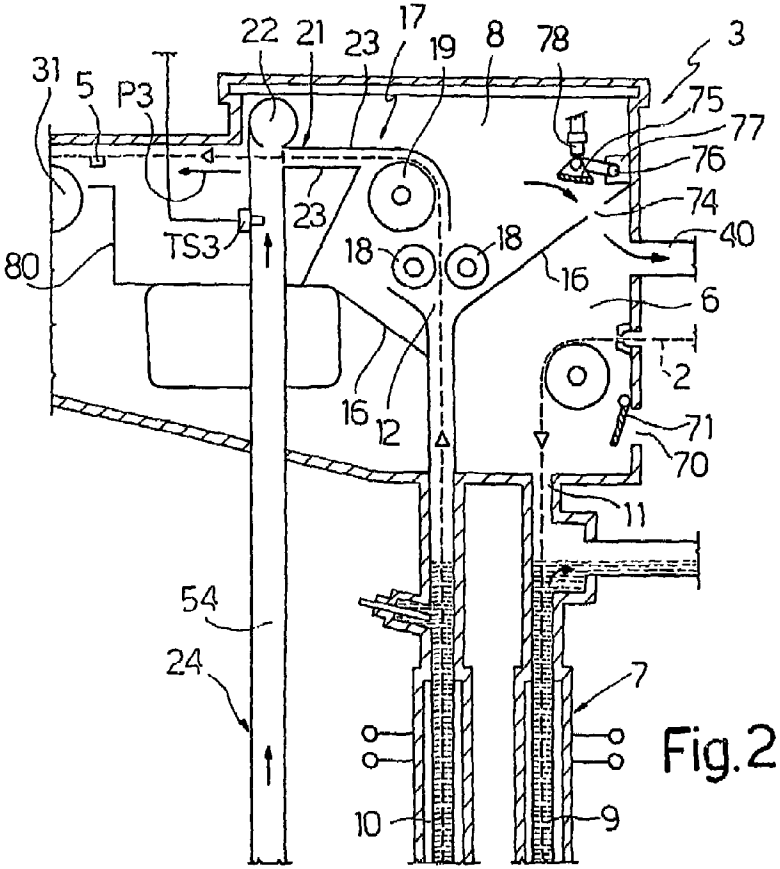

Process chamber 8 (FIGS. 2 and 3) is located over transition chamber 6, is separated from transition chamber 6 by partitions 16, and houses drying means indicated as a whole by 17 and for removing residual sterilizing agent from web 2.

Drying means 17 (FIGS. 2 and 3) comprise two parallel, horizontal, idle wringing rollers 18—at least one of which is covered with a relatively soft material—located close to the inlet of process chamber 8, on opposite sides of web 2, and which cooperate with and exert pressure on respective opposite faces of web 2 to wring any drops of sterilizing agent out and back into bath 7.

Wringing rollers 18 conveniently comprise respective small-diameter intermediate portions (not shown) corresponding with the longitudinal intermediate portion of web 2, as illustrated in EP-A-1050468, to permit the passage of opening devices 5 without interfering with the rollers.

Downstream from wringing rollers 18, web 2 is deflected along a horizontal path P3 by a transmission roller 19.

Drying means 17 also comprise a known so-called "air knife" 21 (shown schematically), which is defined by a nozzle 22 for directing an air jet on to the top face of web 2 eventually defining, in use, the inner surface of each package, and by two plates 23 for directing the jet substantially parallel to, but in the opposite direction to the traveling direction of, web 2.

Nozzle 22 forms part of an air processing circuit 24 described in detail later on.

Sterilizing unit 3 also comprises a vertical aseptic chamber or tower 25 having a top portion 26 communicating with process chamber 8 through an opening 27 for the passage of web 2, and an elongated bottom portion 28, in which web 2 is folded longitudinally into a cylinder and sealed longitudinally to form a continuous tube 29 of packaging material with a vertical axis A. Aseptic chamber 25 and process chamber 8 together therefore define an aseptic environment 30.

Top portion 26 houses a number of transmission and guide rollers 31, 32, 33 for guiding web 2 from horizontal path P3 to a vertical path P4 parallel to axis A of tube 29. More specifically, roller 31 is powered and located immediately downstream from opening 27; roller 32 is idle, and defines a tensioner; and roller 33 is also idle, and provides for drawing and deflecting web 2 downwards.

Tube 29, formed downstream from roller 33 in known manner not described, is filled continuously with the product by a fill conduit 34, and is fed out downwards through a bottom opening 35 in aseptic chamber 25, thus substantially forming an extension of the aseptic chamber.

Machine 1 comprises a known forming and transverse sealing unit 36 (not shown in detail), in which the tube 29 of packaging material is gripped and sealed transversely by pairs of jaws 37 to form aseptic pillow packs 38, which are eventually cut and folded in known manner to form the individual packages.

Air processing circuit 24 comprises a suction conduit 40 communicating with transition chamber 6; and a known processing unit 41 (not shown in detail) having an inlet connected to conduit 40, and an outlet conduit 42. Processing unit 41 conveniently comprises, in known manner, a compressor 43; purifying means 44 for removing residual sterilizing agent; heating means 45 for heating and sterilizing the air; and injection means 46 for spraying the sterilizing agent into outlet conduit 42.

Outlet conduit 42 is connected to an inlet of a three-way valve 47 having an outlet connected to a drain 48, and an outlet connected by a conduit 49 to a distributor 50 for controlling sterile airflow to aseptic environment 30.

Figure 4:
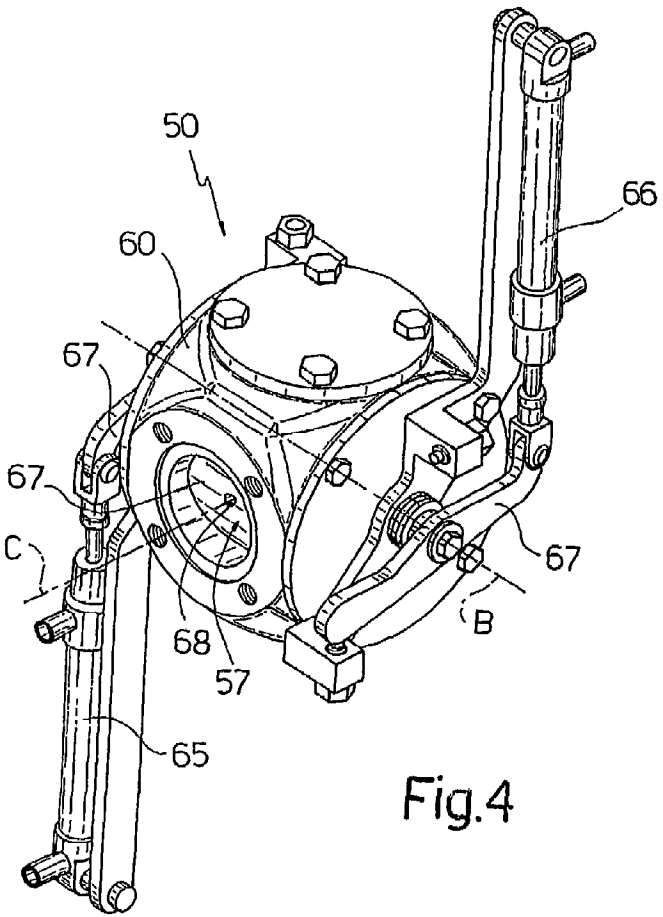
FIG. 4 shows a view in perspective of a distributor for controlling airflow to the sterilizing unit.

More specifically, distributor 50 has an inlet 51 connected to conduit 49; and two outlets 52, 53 connected respectively to nozzle 22 of air knife 21 by a conduit 54, and to one or more air inlets 55 in the bottom portion of aseptic chamber 25 by a conduit 56. In a preferred embodiment of the invention, distributor 50 has two shutters 57, 58, which can be operated independently as shown in detail in FIGS. 4 and 5.

Figure 5:
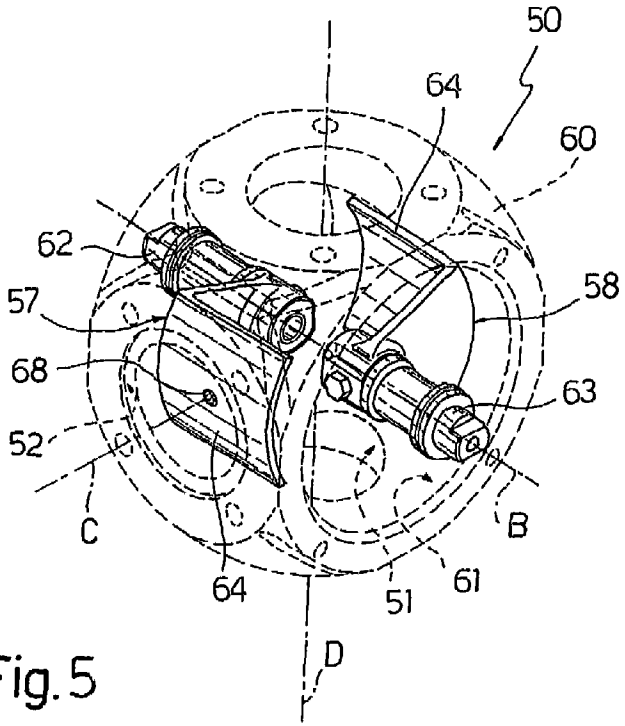
FIG. 5 shows a view in perspective, with parts removed for clarity, of the FIG. 4 distributor.

Distributor 50 (FIG. 4) comprises a substantially spherical casing 60 having a cylindrical inner cavity 61 of axis B; outlets 52, 53 (only one shown in FIGS. 4 and 5) are defined by respective diametrically opposite holes formed in casing 60 and having a common axis C perpendicular to axis B; and inlet 51 is defined by a further hole formed in casing 60 and having an axis D perpendicular to axes B and C (FIG. 5).

Shutters 57, 58 comprise respective cylindrical sealing walls 64 of axis B, which slide substantially hermetically with respect to the inner wall of cavity 61, and are of such an area as to close respective outlets 52, 53. Shutters 57, 58 are connected rigidly to respective drive shafts 62, 63 of axis B, which project axially from opposite sides of casing 60, and are controlled by respective linear servoactuators 65, 66 via respective transmission levers 67. The sealing wall 64 of shutter 57 has a through hole 68 permitting air leakage even in the closed position, as explained in detail later on.

According to the present invention, conduit 54 houses an electric heater 69 for controlling the temperature of the air fed to nozzle 22.

Transition chamber 6 (FIGS. 2 and 3) communicates with the outside environment through an orifice 70 having a hinged cover 71, which is normally closed by gravity, but which opens inwards under low pressure and is therefore open during operation of machine 1. Orifice 70 defines, for circuit 24, a zero pressure reference point with respect to the outside environment, and provides for restoring any air lost through leakage.

Process chamber 8 can communicate with transition chamber 6 through an orifice 74 adjustable by means of a shutter 75.

Shutter 75 is movable—e.g. rotates integrally with a pin 76 controlled by an actuator 77—between an open position (FIG. 2) in which process chamber 8 communicates directly with transition chamber 6, and a closed position (FIG. 3) in which the two chambers are isolated. The open position is conveniently adjustable, e.g. by manually adjusting a mechanical limit stop 78 of shutter 75, even during operation of the machine.

The pressure in aseptic chamber 25 is detected by a sensor PSI with a reading display 79.

In the event web 2 is fitted with opening devices 5, opening 27 between process chamber 8 and aseptic chamber 25 must be high enough, on the underside of web 2 from which opening devices 5 project, to permit passage of the opening devices. To prevent opening 27, the height of which is conditioned as stated above, from substantially equalizing the pressures in aseptic chamber 25 and process chamber 8, opening 27 is not symmetrical with respect to the plane of web 2, but is of minimum height upwards, and is defined downwards by a partition 80 bent 90° towards roller 31 so as to get close to the roller and so define an airflow barrier and, therefore, a concentrated fall in pressure.

A conduit 81 for sterilizing fill conduit 34 is branch-connected to conduit 49; and fill conduit 34 is selectively connectable to conduit 81 and to a food product supply conduit 83 by means of an aseptic three-way valve 82 suitable for food applications, such as a vapor-barrier valve.

A programmable control unit 84 of machine 1 controls the process parameters of sterilizing unit 3 on the basis of predetermined reference values at each operating stage of the machine, and, in particular, controls valves 47 and 82, distributor 50, heating means 45 and injection means 46 of air processing unit 41, peroxide control circuit 15, heater 69, and actuator 77.

The process parameters, which may be different variables at different operating stages, are defined, for example, by the temperature of the air from unit 41, as detected by a first sensor TS1; the temperature in top portion 26 of aseptic chamber 25, as detected by a second sensor TS2; and the air temperature in conduit 54, upstream from nozzle 22, as detected by a third sensor TS3.

Sterilizing unit 3 operates as follows:

When machine 1 is started, a hot sterilizing step commences, in which compressor 43 and heating means 45 of the processing unit are activated to superheat and sterilize the air drawn in along conduit 40, and to preheat aseptic chamber 25.

Figure 6:
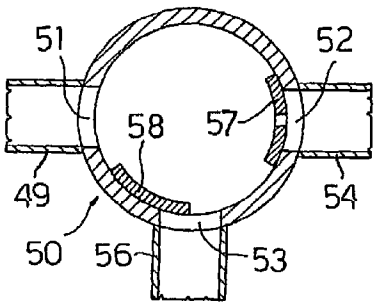

For this purpose, distributor 50 is set to the FIG. 6 position, in which outlet 52 is substantially closed by shutter 57, except for leakage through hole 68, and outlet 53 is partially open, so that substantially all the air from conduit 49 is fed into aseptic chamber 25.

Valve 82 isolates fill conduit 34 from food product supply conduit 83, and connects it to conduit 81.

At the hot sterilizing step, valve 47 is controlled by unit 84 on the basis of the air temperature in the top portion of aseptic chamber 25, as detected by sensor TS2, to achieve a superheating temperature of, say, 280° C., in conduit 42.

More specifically, at the start-up transient stage, valve 47 feeds hot air into conduit 49 until the temperature in aseptic chamber 25 reaches a predetermined preheat temperature, e.g. 40° C.; at which point, valve 47 switches to discharge the hot air to the outside. From this point on, valve 47 operates intermittently, alternately injecting and discharging air to keep aseptic chamber 25 at roughly the predetermined preheat temperature.

At the same time, the temperature in conduit 42 rises gradually, until, in response to a signal from sensor TS1 indicating the predetermined superheating temperature (280° C.) has been reached in conduit 42, control unit 84 switches to the next step to chemically sterilize aseptic environment 30 and fill conduit 34.

For this purpose, injection means 46 are activated; valve 47 remains in position connecting conduit 49 to conduit 42; valve 82 remains in position connecting fill conduit 34 to air processing unit 41; and distributor 50 remains in the FIG. 6 position.

A stream of superheated air and peroxide vapor is thus created, and which is fed partly to fill conduit 34 and partly to aseptic chamber 25 via distributor 50 and inlets 55. A small percentage of the stream is fed through hole 68 to conduit 54, and by this to nozzle 22.

The stream flows through opening 27 from aseptic chamber 25 to process chamber 8; and, since orifice 74 is closed by shutter 75 (FIG. 3) and bath 7 is empty, the stream flows along the whole length of bath 7 up to transition chamber 6, where it is drawn along conduit 40 and recirculated back to processing unit 41. Inevitable losses along the processing circuit produce a slight fall in pressure in transition chamber 6, and are therefore compensated by ambient air through orifice 70.

Opening 27 is sized to maintain a pressure of about 20–30 $mmH_2O$ in the aseptic chamber, and a pressure of 10–20 $mmH_2O$ in process chamber 8, with a pressure drop of about 10 $mmH_2O$ through opening 27.

The above overpressure values with respect to the environment are sufficient to prevent entry of external agents, but low enough to prevent substantial leakage of sterilizing-agent-contaminated air from contaminating the workplace. The pressure drop through opening 27 ensures continuous one-way flow from aseptic chamber 25 to process chamber 8.

After a predetermined time lapse, during which the fill conduit is isolated, the chemical sterilizing step is followed by a drying step.

Figure 7:
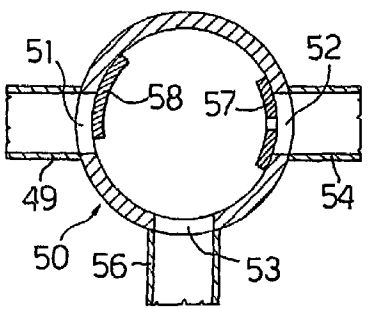

During the drying step, fill conduit 34 is first superheated by switching distributor 50 to the FIG. 7 position, i.e. in which shutter 58 partly closes inlet 51. This increases superheated airflow along fill conduit 34, where the high temperature, which accelerates peroxide disassociation, and the dynamic effect combine synergically to thoroughly sterilize, and remove the peroxide from, fill conduit 34.

Figure 8:
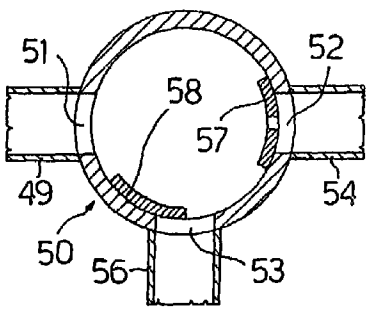
FIGS. 6, 7, 8, 9 and 10 show various positions of the distributor in different operating conditions of the machine.

Following superheating of fill conduit 34, which lasts, say, two minutes, distributor 50 is restored to the FIG. 8 position, and drying of aseptic chamber 25 continues, e.g. for a total of 15 minutes, by feeding air into aseptic chamber 25 mainly through inlets 55.

During the drying step, the temperature reference parameters are modified to maintain a maximum temperature, as defined by sensor TS1, of, for example, less than 200° C., and a temperature of roughly 95° C. in aseptic chamber 25. The first of the above conditions ensures air is fed through inlets 55 into aseptic chamber 25 at a safe temperature of roughly 140–150° C.

This completes the set-up cycle, and is followed by the production step.

During production (FIG. 2), bath 7 is full of sterilizing solution, and web 2 is fed through the bath, is dried in process chamber 8, and is sealed longitudinally into a tube in aseptic chamber 25. At the same time, valve 82 is switched to feed the food product along fill conduit 34.

Figure 9:
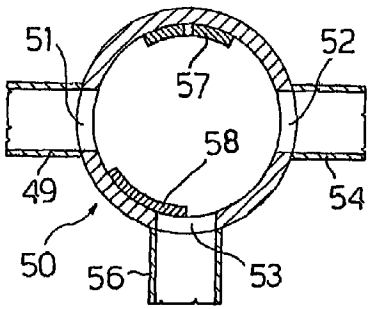

In the above operating condition, shutter 58 of distributor 50 is positioned (FIG. 9) to partly close outlet 53 connected to inlets 55, and outlet 52 is fully opened so as to feed a substantial portion, e.g. 40%, of the stream to nozzle 22, and the rest, e.g. 60%, to aseptic chamber 25. Since the sterilizing agent prevents air from circulating through bath 7, shutter 75 is now opened, so that process chamber 8 communicates directly with suction conduit 40 of air processing circuit 24.

In this way, and by varying flow distribution to aseptic chamber 25 and process chamber 8, and by correct sizing of opening 27 and the flow section of orifice 74 with shutter 75 in the open position, the aseptic chamber and process chamber 8 can be maintained substantially at the optimum pressure conditions referred to above, i.e. 10–20 $mmH_2O$ in the process chamber, and roughly 20–30 $mmH_2O$ in the aseptic chamber, with a pressure drop of roughly 10 $mmH_2O$ through opening 27.

During production, the air temperature at the outlet of unit 41 is roughly 120° C., and heater 69 is controlled, on the basis of feedback from sensor TS3, to supply nozzle 22 with air at roughly 180° C., thus enabling accurate temperature control of the airstream used to dry web 2, and therefore optimum drying and sterilization of the web.

Sensor TS2 in the aseptic chamber only provides, in this case, for minimum-temperature control, and activates an alarm in the event the temperature in aseptic chamber 25 falls below a minimum safety threshold of, say, 70° C. Similarly, the pressure in aseptic chamber 25 during production is detected by sensor PSI, which activates an emergency stop in the event the pressure in aseptic chamber 25 falls below a minimum safety threshold.

If the pressure in aseptic chamber 25, while remaining within an acceptable range, tends to fall, during production, towards the minimum safety value, e.g. due to poor sealing, this can be corrected during production by manually adjusting limit stop 78 to adjust, and in particular reduce, the flow section of orifice 74.

During short production stoppages for any routine servicing of machine 1, web 2 is stopped and bath 7 emptied.

Figure 10:
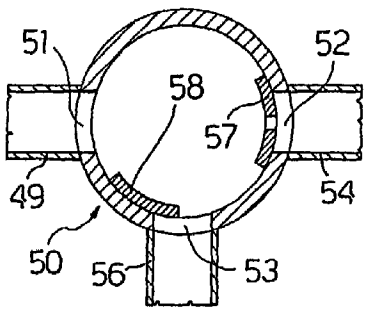

In this condition, shutter 58 of distributor 50 is set to maintain outlet 53 partially open, and shutter 57 is set to substantially close outlet 52 (FIG. 10) except for hole 68, so that flow is substantially supplied entirely to aseptic chamber 25, and a minimum portion of about a few percent, e.g. 3%, to air knife 21.

As described above relative to the preliminary chemical sterilizing and drying steps, flow travels through opening 27 from aseptic chamber 25 to process chamber 8; and, since orifice 74 is closed by shutter 75, and bath 7 is empty, travels along the whole length of bath 7 up to transition chamber 6, where it is drawn along conduit 40 and recirculated back to processing unit 41.

The new flow distribution, now almost entirely supplied to aseptic chamber 25, combined with the opening of orifice 74 and appropriate sizing of orifice 74 and opening 27, provides for still maintaining optimum pressure values in aseptic chamber 25 and process chamber 8.

By virtue of its high thermal inertia, aseptic chamber 25 acts, at this stage, as a cooler to cool the air flowing through it and through opening 27 into process chamber 8 and bath 7. This "ventilation" of the bath cools web 2 and reduces so-called "edge wicking"—impregnation of the edges of web 2 with sterilizing agent—when bath 7 is next filled to start up the machine. Edge wicking, which occurs at the edges of web 2 where the paper layer is exposed, can be substantially reduced by reducing the temperature of bath 7 and web 2 by ventilation as described above, and by loading the sterilizing agent at an appropriately high temperature when the machine is started up.

Clearly, changes may be made to machine 1, and in particular to sterilizing unit 3, without, however, departing from the scope of the accompanying claims.

In particular, distributor 50 may be replaced with a different type, or by a pair of conventional throttle valves.

The invention claimed is:

1. A sterilizing unit for sterilizing a web of packaging material on a machine for packaging pourable food products, the sterilizing unit comprising:

a bath containing a sterilizing agent, in which said web is fed continuously;

an aseptic environment comprising a process chamber connected to an outlet of said bath and housing drying means for removing residual sterilizing agent from said web; and an aseptic chamber communicating with said process chamber via an opening for the passage of said web, and in which said web is folded and sealed longitudinally to form a tube which is filled continuously with the product for packaging;

said drying means comprising at least one nozzle for directing a stream of sterile air on to said web; and an air processing circuit for controlling the process conditions in said aseptic environment, and comprising suction means for drawing air from said process chamber; and air processing means comprising first heating means, and first supply means for feeding sterile air into said aseptic chamber;

comprising second supply means for supplying sterile air from said air processing means to said nozzle; and second heating means associated with said second supply means and for controlling the temperature of the air supplied to said nozzle.

2. A unit as claimed in claim 1, comprising first valve means for adjustably connecting said first supply means and said second supply means to said air processing means.

3. A unit as claimed in claim 2, wherein said first valve means comprise a distributor having an inlet connected to said air processing means, first and second outlets connected to said first supply means and said second supply means respectively, and a first and a second shutter for regulating flow from said inlet to each of said outlets.

4. A unit as claimed in claim 3, wherein said distributor comprises a casing having a cylindrical cavity in turn having an axis; said inlet and said outlets being defined by respective holes formed in said casing, having axes perpendicular to said axis of said cavity, and communicating with said cavity.

5. A unit as claimed in claim 4, wherein said shutters have respective cylindrical sealing surfaces coaxial with said cavity, and which slide hermetically with respect to an inner surface of said cavity.

6. A unit as claimed in claim 5, wherein said shutters rotate about said axis of said cavity.

7. A unit as claimed in claim 6, wherein said shutters are controlled by respective actuators.

8. A unit as claimed in claim 3, wherein one of said shutters comprises a hole permitting residual flow to said second supply means, even when said second outlet is closed.

9. A unit as claimed in claim 2, comprising a transition chamber communicating with an inlet of the bath and with said suction means; and second valve means interposed between said process chamber and said transition chamber, and movable between an open position in which said process chamber communicates directly with said transition chamber, and a closed position in which said process chamber communicates with said transition chamber via said bath.

10. A unit as claimed in claim 9, wherein said transition chamber communicates with the outside environment through a normally-closed orifice which opens under low pressure.

11. A unit as claimed in claim 1, comprising a barrier for producing a localized pressure drop between said aseptic chamber and said process chamber; said barrier defining said opening, through which said web is fed, between said process chamber and said aseptic chamber.

12. A unit as claimed in claim 1, for processing a web of packaging material fitted with opening devices projecting from one face of said web; wherein said opening is asymmetrical with respect to the traveling plane of said web, and is higher on the side facing the face of said web from which said opening devices project.

13. A unit as claimed in claim 12, comprising a roller for guiding said web and housed in said aseptic chamber, immediately downstream from said opening; said barrier comprising a partition defining said opening and shaped to get close to said roller.

* * * * *